US007370577B2

(12) United States Patent
Naitou et al.

(10) Patent No.: US 7,370,577 B2
(45) Date of Patent: May 13, 2008

(54) STENCIL PRINTING MACHINE USING SUCTION OF INK RECOVERY UNIT TO FIT STENCIL SHEET TO DRUM

(75) Inventors: Taku Naitou, Ibaraki-ken (JP); Keita Usuda, deceased, late of Tokyo (JP); by Hiroshi Usuda, legal representative, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 3 days.

(21) Appl. No.: 11/496,716

(22) Filed: Aug. 1, 2006

(65) Prior Publication Data

US 2007/0181015 A1 Aug. 9, 2007

(30) Foreign Application Priority Data

Aug. 2, 2005 (JP) ..... 2005-223874

(51) Int. Cl.
*B41L 13/16* (2006.01)
*B41L 13/18* (2006.01)

(52) U.S. Cl. ..... 101/128.1; 101/116; 101/119

(58) Field of Classification Search ..... 101/116, 101/119, 120, 128.1
See application file for complete search history.

(56) References Cited

U.S. PATENT DOCUMENTS

2005/0056169 A1* 3/2005 Hashimoto et al. ..... 101/119
2005/0211115 A1* 9/2005 Nakamura et al. ..... 101/116
2005/0217516 A1* 10/2005 Naitou et al. ..... 101/119

FOREIGN PATENT DOCUMENTS

JP 2005-074734 3/2005

* cited by examiner

*Primary Examiner*—Leslie J Evanisko
(74) *Attorney, Agent, or Firm*—The Nath Law Group; Jerald L. Meyer; Derek Richmond

(57) ABSTRACT

A stencil printing machine includes a rotatable drum having an outer circumferential wall formed by an ink impermeable member, a stencil clamping part for clamping a leading end of a stencil sheet, an ink supply unit having an ink supply opening for supplying a surface of the outer circumferential wall with ink, a press roll for pressing a printing paper against the outer circumferential wall of the drum, an ink recovery unit having an ink recovery opening formed on a downstream side of a maximum printing area in a printing direction to collect ink flowing into the ink recovery opening by suction, the maximum printing area being defined on the outer circumferential wall, and a press unit for pressing the stencil sheet onto the outer circumferential wall of the drum and a control unit for controlling respective operations of the main motor, the ink recovery unit and the press unit. In process of fitting the stencil sheet on the drum while clamping the leading end of the stencil sheet by the stencil clamping part, the control unit allows the press unit to press the stencil sheet onto the outer circumferential wall of the drum and further allows the ink recovery unit to start its sucking operation through the ink recovery opening.

6 Claims, 11 Drawing Sheets

STENCIL PRINTING MACHINE USING SUCTION OF INK RECOVERY UNIT TO FIT STENCIL SHEET TO DRUM

BACKGROUND OF THE INVENTION

1. Field of the Invention

The present invention relates to a stencil printing machine that feeds a printing medium while pressing it to a drum having a stencil sheet and transfers ink permeating through perforations in the stencil sheet to the printing medium.

2. Description of Related Art

In this kind of stencil printing machine, an applicant of this specification has proposed a stencil printing machine disclosed in Japanese Patent Laid-Open Publication No. 2005-74734. This stencil printing machine comprises a rotary drum having an outer circumferential wall formed by an ink impermeable member, a stencil clamping part for clamping a leading end of stencil sheet, ink supply unit having an ink supply opening formed on the outer circumferential wall to supply a surface of the outer circumferential wall with ink, a press roll adapted so as to be movable between a press position for pressing the outer circumferential wall and a standby position apart from the outer circumferential wall, for pressing the stencil sheet against the outer circumferential wall, and ink recovery means (unit) having an ink recovery opening formed on a "printing" downstream side of a maximum printing area defined on the outer circumferential wall to collect "runoff" ink into the ink recovery opening by suction.

In printing, the outer circumferential wall equipped with the stencil sheet is rotated. When supplying a printing paper on condition that the outer circumferential wall is supplied with ink through the ink supply opening, the printing paper is transported while being pressed on the stencil sheet and the outer circumferential wall of the drum by the press roll. Meanwhile, the ink between the outer circumferential wall and the stencil sheet is diffused toward the "printing" downstream side in the printing direction by the pressure of the press roll. Simultaneously, the diffused ink exuding out through perforations in the stencil sheet is transferred on the printing paper, so that an ink image is printed on the paper. Note that, the ink on supply is retained in a substantially closed space between the outer circumferential wall and the stencil sheet, keeping ink's contact with atmosphere to a minimum. Additionally, there is no need of arranging a variety of rolls for ink supply in the drum. Thus, the above-mentioned printing machine has an advantage that the ink would not degenerate in spite of a long interval between the printing operations. Further, it is possible to miniaturize and lighten the drum itself.

Meanwhile, a stencil fitting operation to fit the stencil sheet to the outer circumferential wall of the drum is accomplished by the following steps of: clamping the leading end of the stencil sheet by the stencil clamping part; gradually winding the stencil sheet around the outer circumferential wall while rotating the drum; cutting the stencil sheet by a predetermined length during the above winding; and further rotating the outer circumferential wall after cutting the stencil sheet thereby winding the so-cut stencil sheet of the predetermined length around the outer circumferential wall of the drum.

In the conventional stencil printing machine mentioned above, however, the ink rarely remains on the surface of the outer circumferential wall once the stencil sheet is discharged from the outer circumferential wall because it is formed by the ink impermeable member. Even if it remains, the residual ink would be dried immediately. Thus, since the above stencil fitting operation is performed under condition of establishing no ink-viscosity on the outer circumferential wall, it is impossible to wind the stencil sheet around the drum with no wrinkle by the following reason.

That is, if the ink-viscosity exists on the outer circumferential wall, the stencil sheet wound around the outer circumferential wall with no wrinkle could maintain its winding state owing to the ink-viscosity. Therefore, even when tension is removed away from the stencil sheet by its reaction force at cutting, there is no possibility that the stencil sheet wrinkles up. However, in case of the outer circumferential wall formed by the ink impermeable member, the stencil sheet wrinkles up with ease due to the reaction force at cutting or the application of no tension after cutting. It follows that it is impossible to wind the stencil sheet around the drum without producing any wrinkle.

SUMMARY OF THE INVENTION

In the above-mentioned situation, it is an objective of the present invention to provide a stencil printing machine having a drum whose outer circumferential wall is formed by an ink impermeable member, which allows a stencil sheet to be fitted to the outer circumferential wall without producing any wrinkle.

According to a first aspect of the present invention, there is provided a stencil printing machine comprising: a drum rotated by a main motor, the drum having an outer circumferential wall formed by an ink impermeable member; a stencil clamping part provided on the outer circumferential wall to clamp a leading end of a stencil sheet; an ink supply unit having an ink supply opening positioned in the outer circumferential wall to supply a surface thereof with ink; a press roll arranged close to the drum to press a printing medium on supply against the outer circumferential wall of the drum; an ink recovery unit having an ink recovery opening formed on a downstream side of a maximum printing area in a printing direction of the stencil printing machine to collect ink flowing into the ink recovery opening by suction, the maximum printing area being defined on the outer circumferential wall; a press unit for pressing the stencil sheet onto the outer circumferential wall of the drum; and a control unit for controlling respective operations of the main motor, the ink recovery unit and the press unit, wherein in process of fitting the stencil sheet on the drum while clamping the leading end of the stencil sheet by the stencil clamping part, the control unit allows the press unit to press the stencil sheet onto the outer circumferential wall of the drum and further allows the ink recovery unit to start its sucking operation through the ink recovery opening.

In the present invention of the first aspect, since the stencil sheet is pressed on the outer circumferential wall of the drum by the press unit in the stencil fitting process, the stencil sheet is wound around the drum without producing any wrinkle. Further, the ink recovery unit starts its sucking operation through the ink recovery opening in the stencil fitting process. Thus, the stencil sheet while producing no wrinkle is absorbed onto the outer circumferential wall by suction force through the ink recovery opening. Therefore, in spite of employing the drum whose outer circumferential wall is formed by the ink impermeable member, it is possible to fit the stencil sheet onto the outer circumferential wall of the drum without producing any wrinkle.

According to the second aspect of the present invention, in the process of fitting the stencil sheet on the drum, the starting point of the sucking operation by the ink recovery unit is established between a point of time when the ink recovery opening of the ink recovery unit passes through the press unit completely and another point of time when the press unit presses a trailing end of the stencil sheet.

In the present invention of the second aspect, the starting point of the sucking operation by the ink recovery unit is preset between the point of time when the ink recovery opening of the ink recovery unit passes through the press unit completely and the point of time when the press unit presses the trailing end of the stencil sheet. Due to the positioning of the ink recovery opening (on the downstream side of the maximum printing area), the suction force of the ink recovery unit is applied on the stencil sheet's end portion close to the trailing end. Therefore, it becomes possible to fit an overall area of the stencil sheet onto the outer circumferential wall of the drum without producing any wrinkle.

According to the third aspect of the invention, the stencil printing machine of the first aspect further comprises a position detecting device for detecting a rotational position of the drum in rotation, wherein the control unit controls the operation of the ink recovery unit and the operation of the press unit on a basis of the rotational position of the drum detected by the position detecting device.

In this case, owing to the addition of the position detecting device for detecting a rotational position of the drum in rotation, the operations of the ink recovery unit and the press unit can be automatically performed by monitoring the rotational position of the drum detected by the position detecting device.

According to the fourth aspect of the invention, in the stencil printing machine of the third aspect, the position detecting device comprises a reference-position detecting sensor arranged in the stencil printing machine and connected to the control unit, for detecting a reference position defined in the drum and a rotary encoder arranged in the stencil printing machine and connected to the control unit, for outputting pulse signals with rotation of the main motor.

In the fourth aspect of the invention, the rotational position of the drum can be calculated by detecting the number of output pulses generated from the rotary encoder on the basis of a signal (reference signal) generated from the reference-position detecting sensor.

According to the fourth aspect of the invention, the press unit comprises the press roll.

Then, since the press roll for printing is employed as a constituent of the press unit, the structure of the stencil printing machine is simplified and additionally, it is possible to reduce its manufacturing cost.

These and other objectives and features of the present invention will become more fully apparent from the following description and appended claims taken in conjunction with the accompanied drawings.

DETAILED DESCRIPTION OF THE PREFERRED EMBODIMENT

One embodiment of the present invention will be described with reference to drawings.

Figure 1:
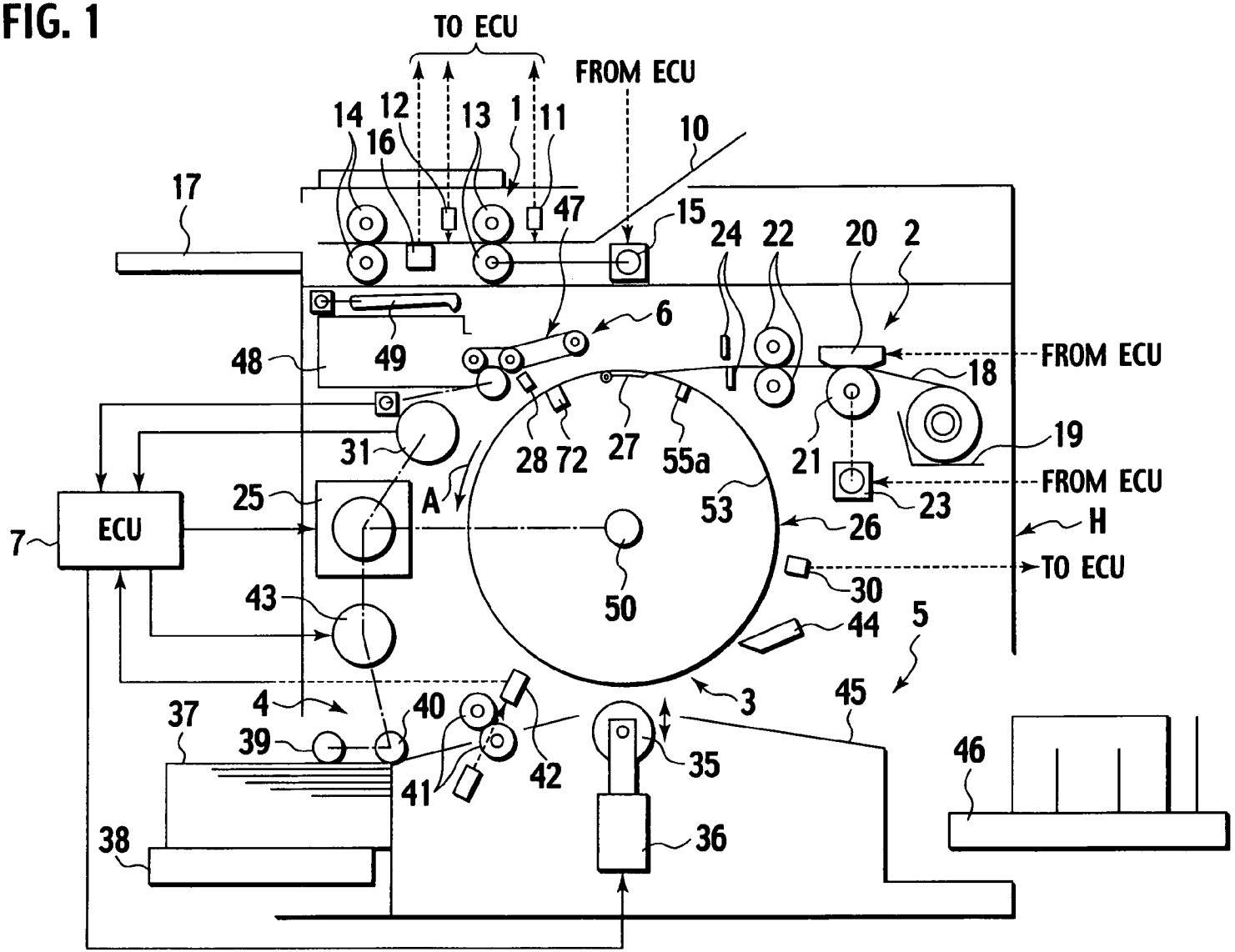
FIG. 1 is a schematic structural view of a stencil printing machine in accordance with an embodiment of the present invention.
Figure 2:
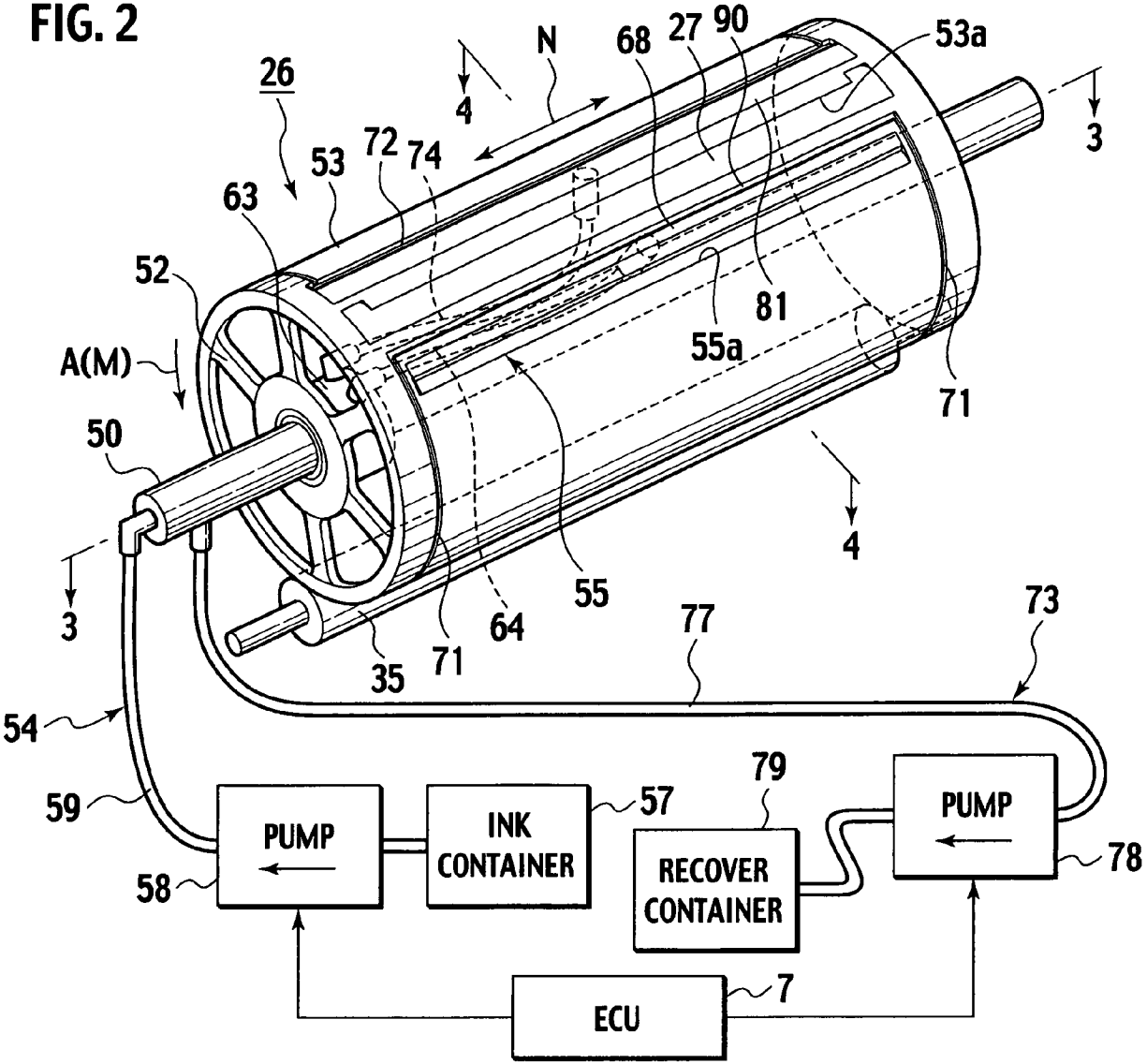
FIG. 2 is a perspective view of a drum in which a pressing mechanism is eliminated, showing the embodiment of the present invention.
Figure 3:
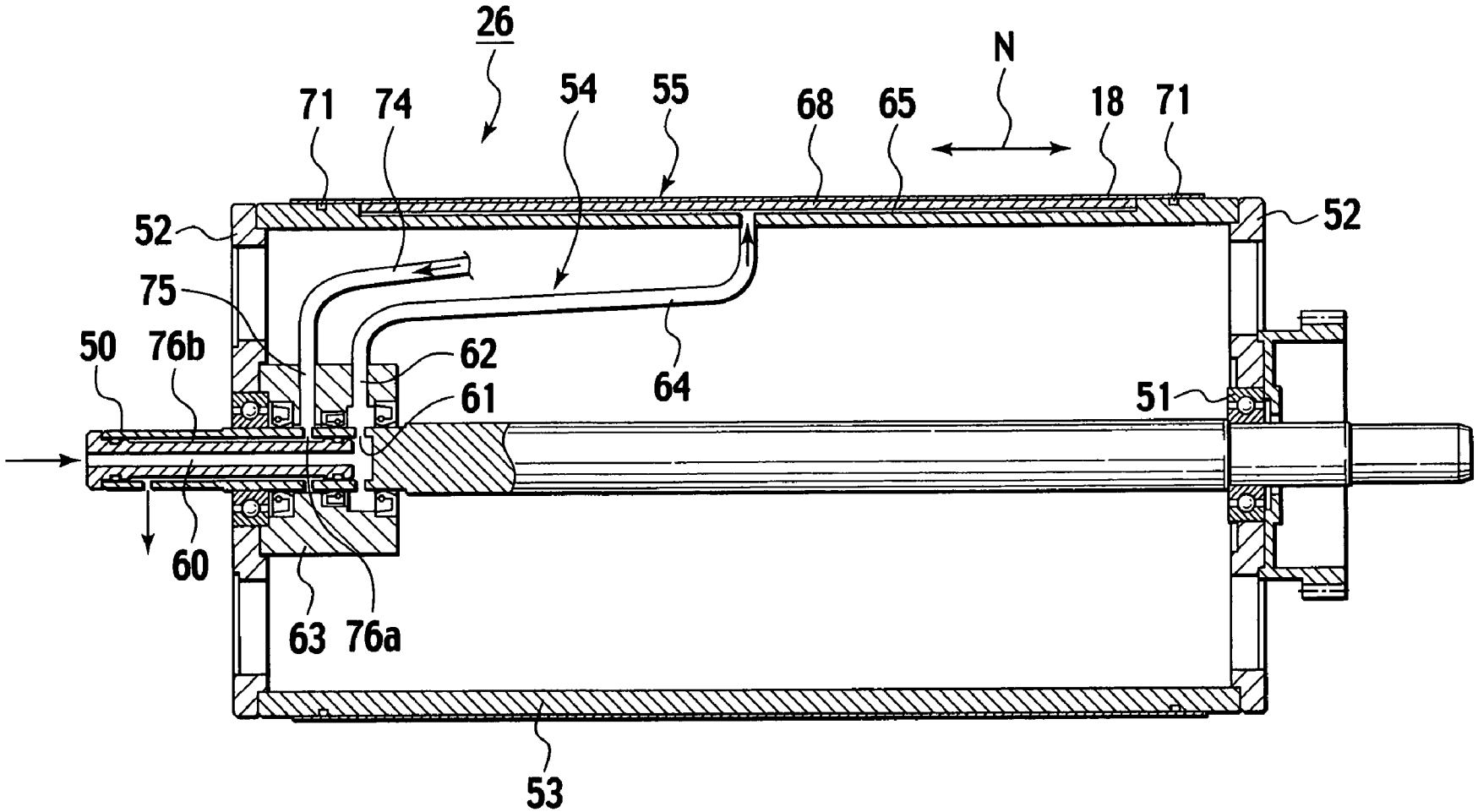
FIG. 3 is a sectional view taken along a line 3-3 of FIG. 2, showing the embodiment of the present invention.
Figure 4:
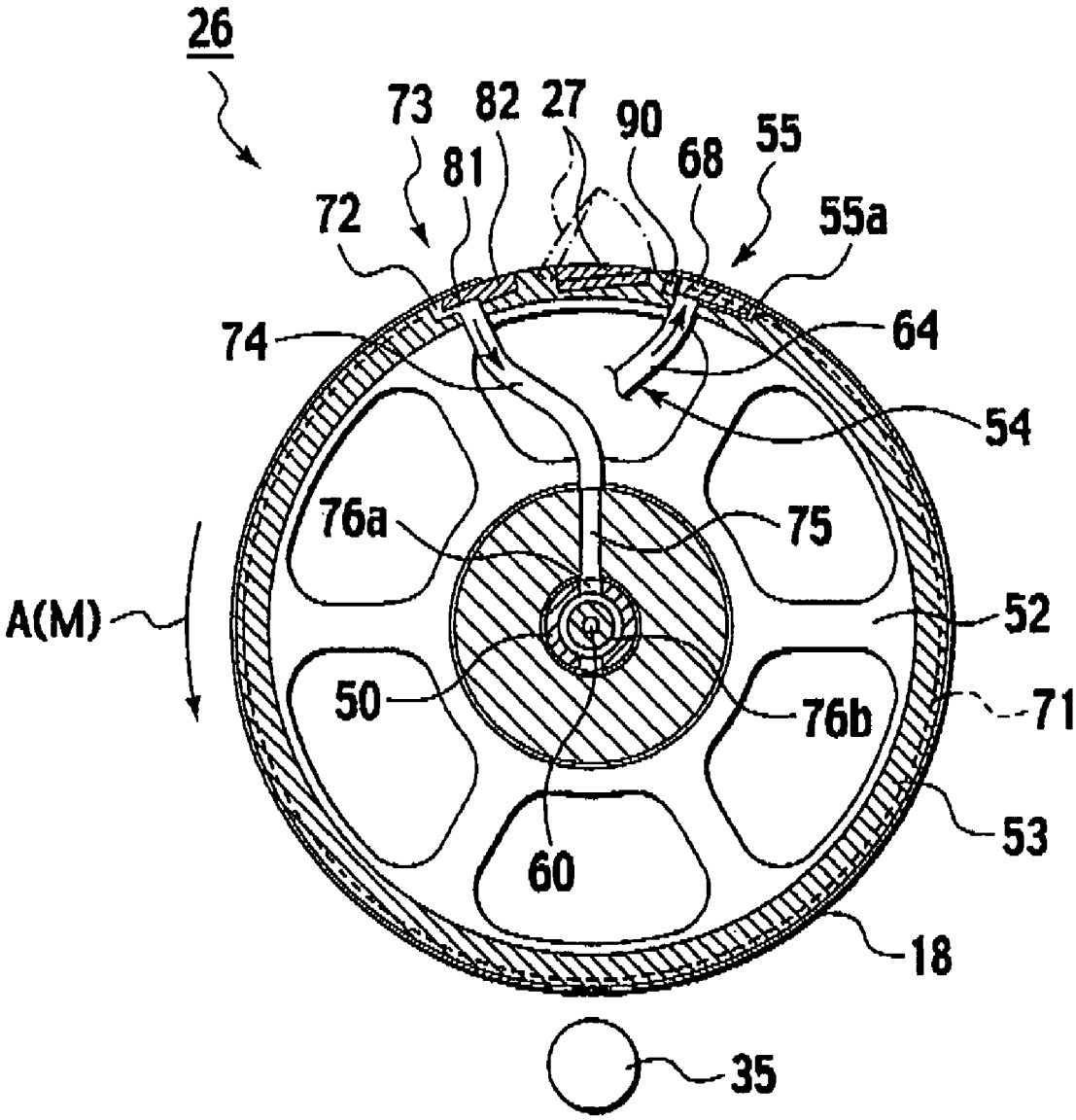
FIG. 4 is a sectional view taken along a line 4-4 of FIG. 2, showing the embodiment of the present invention.
Figure 5:
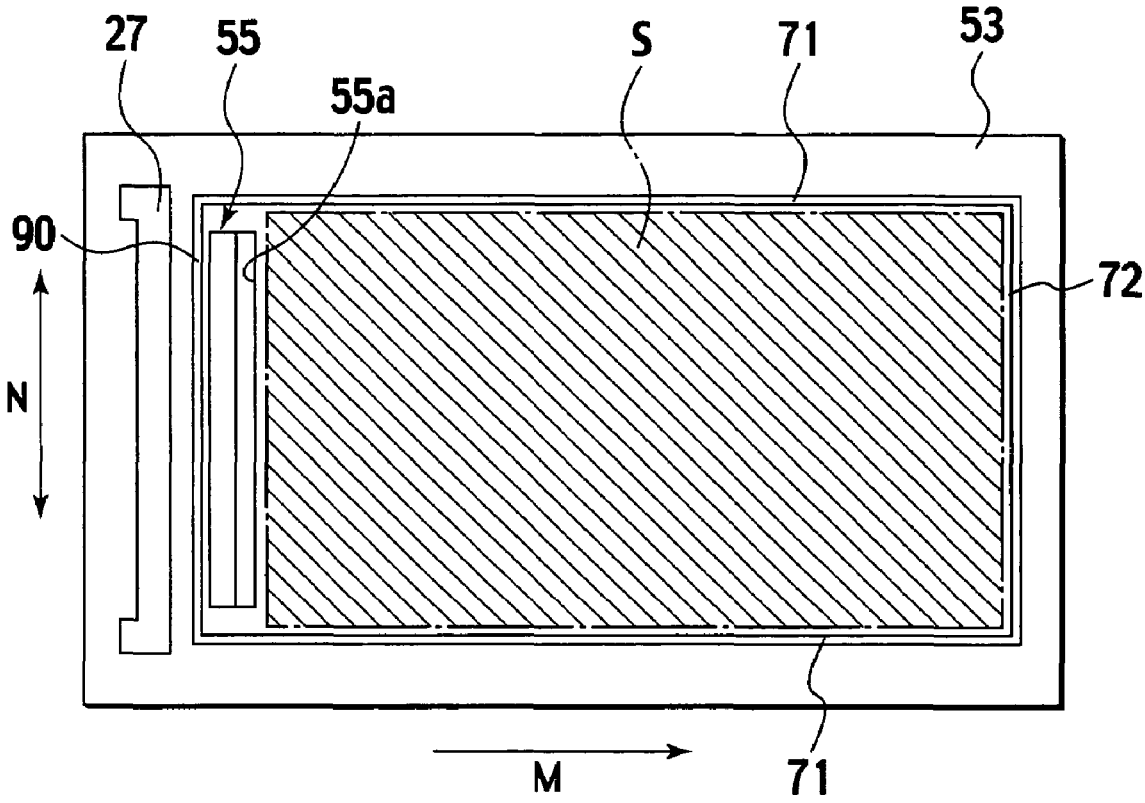
FIG. 5 is a schematic view where an outer circumferential wall of the drum is unfolded, showing the embodiment of the present invention.
Figure 6:
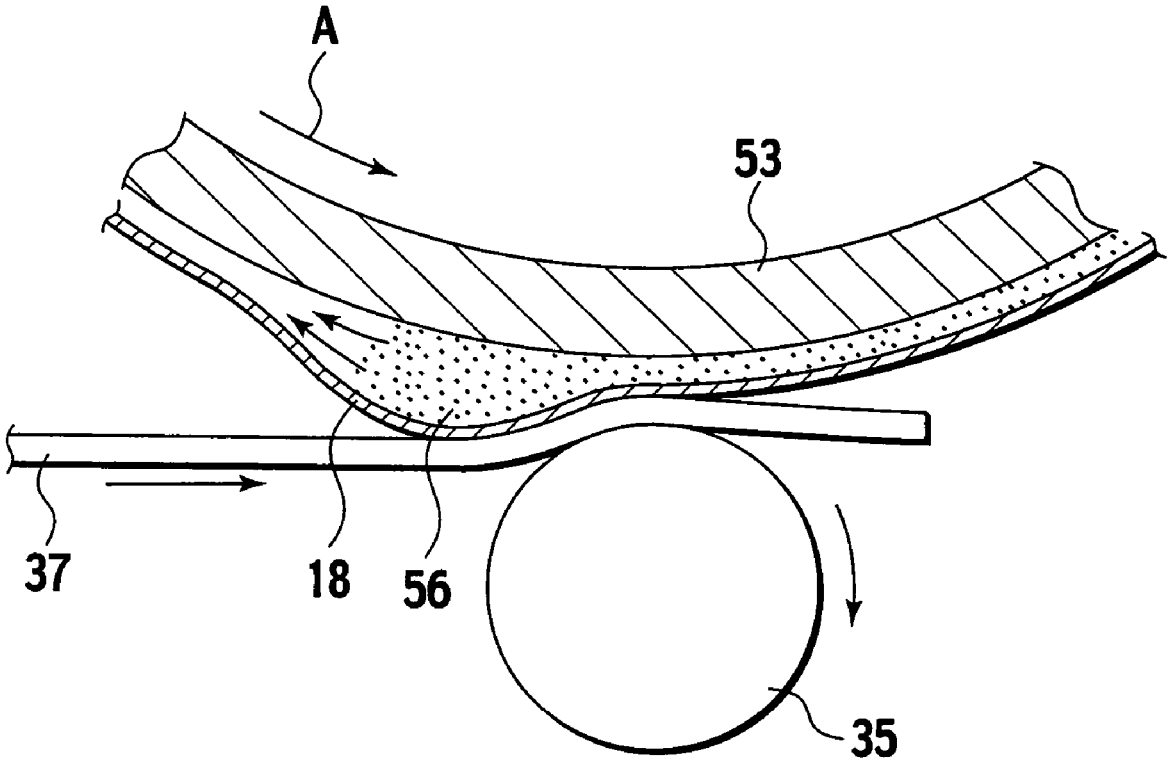
FIG. 6 is a partial sectional view explaining a diffusion mechanism of ink, showing the embodiment of the present invention.

FIGS. 1 to 11 show an embodiment of the present invention commonly. In the figures, FIG. 1 is a schematic structural view of a stencil printing machine. FIG. 2 is a perspective view of a drum having a pressing mechanism eliminated. FIG. 3 is a sectional view taken along a line 3-3 of FIG. 2, while FIG. 4 is a sectional view taken along a line 4-4 of FIG. 2. FIG. 5 is a schematic view where an outer circumferential wall of the drum is unfolded. FIG. 6 is a partial sectional view explaining a diffusion mechanism of ink. FIGS. 7 to 11 are schematic structural views showing respective stencil fitting processes of the stencil printing machine.

As shown in FIG. 1, the stencil printing machine mainly comprises an original (manuscript) scanning part 1, a stencil making part 2, a printing part 3, a paper feed part 4, a paper discharging part 5, a stencil disposal part 6 and a control unit 7.

The original scanning part 1 includes a manuscript setting table 10 for mounting an original manuscript to be printed, reflection type manuscript sensors 11, 12 for detecting the original manuscript mounted on the manuscript setting table 10, manuscript loading rolls 13, 14 for transferring the manuscript on the manuscript setting table 10, a stepping motor 15 for rotating the manuscript loading rolls 13, 14, a contact type image sensor 16 for reading image data of the manuscript transferred by the manuscript loading rolls 13, 14 optically and further converting the image data into electrical signals and a manuscript discharging tray 17 for mounting the manuscript discharged from the manuscript setting table 10. In operation, a manuscript mounted on the manuscript setting table 10 is transferred by the manuscript loading rolls 13, 14, while image data in the transferred manuscript is scanned by the image sensor 16. Outputs of the manuscript sensors 11, 12 are inputted to the control unit 7. Additionally, an output of the image sensor 16 is inputted to the control unit 7. While, the operation of the stepping motor 15 is controlled by the control unit 7 inputting respective signals of these sensors 11, 12 and 16.

The stencil making part 2 includes a stencil accommodating part 19 for accommodating a rolled long stencil sheet 18, a thermal head 20 arranged on the downstream side of the stencil accommodating part 19, a platen roll 21 opposed to the thermal head 20, a pair of stencil feeding rolls 22, 22 arranged on the downstream side of the platen roll 21 and the thermal head 20, a light pulse motor 23 for rotating the platen roll 21 and the stencil feeding rolls 22, 22 and a stencil cutter 24 arranged on the downstream side of the stencil feeding rolls 22, 22. The thermal head 20, the light pulse motor 23 and the stencil cutter 24 are electrically connected to the control unit 7.

In operation, with rotation of the platen roll 21 and the stencil feed rolls 22, 22, the long stencil sheet 18 is transferred. During this transportation, dotted heater elements in the thermal head 20 are selectively heated on the basis of image data obtained by the image sensor 16. Consequently, the stencil sheet 18 is perforated in heat to make a stencil. Next, the so-perforated stencil sheet 18 is cut off by the stencil cutter 24, producing a stencil sheet 18 of a predetermined length. Note that, the above-mentioned operations of the thermal head 20, the light pulse motor 23 and the stencil cutter 24 are controlled by the control unit 7.

The printing part 3 includes a drum 26 rotated in a direction of arrow A (FIG. 1) by a main motor 25, a stencil clamping part 27 arranged on an outer circumferential wall 53 of the drum 26 to clamp a leading end of the stencil sheet 18, an ink supply unit 54 for supplying a surface of the outer circumferential wall 53 with ink and an ink recovery unit 73 for recovering extra ink on the surface of the outer circumferential wall 53. Note that, the rotation of the main motor 25 is controlled by the control unit 7. Further the above-mentioned operations of the stencil clamping part 27, the ink supply unit 54 and the ink recovery unit 73 are controlled by the control unit 7, respectively.

Again, the printing part 3 further includes a stencil confirmation sensor 28 for detecting whether the stencil sheet 18 is wrapped on the outer circumferential surface of the drum 26 or not, a reference-position detecting sensor 30 for detecting a reference position defined on the drum 26 and a rotary encoder 31 for detecting the rotation (rotational angle) of the main motor 25. By detecting (or counting the number of) pulse signals generated from the rotary encoder 31 on the ground of an output signal from the reference-position detecting sensor 30, it is possible to detect a rotational position of the drum 26 precisely. For this purpose, all of the stencil confirmation sensor 28, the reference-position detecting sensor 30 and the rotary encoder 31 are electrically connected to the control unit 7. Thus, respective outputs of these sensors and encoder are inputted into the control unit 7.

The printing part 3 further includes a press roll 35 arranged below the drum 26. The press roll 35 is constructed so as to be movable between a press position where a solenoid unit 36 allows the press roll 35 to press on the outer circumferential surface of the drum 26 and a standby position where the press roll 35 is apart from the outer circumferential surface of the drum 26. During a printing mode (including a first printing), the press roll 35 is always positioned at the press position. While, during other periods except the printing mode, the press roll 35 is positioned at the standby position. The activation/inactivation of the solenoid unit 36 is controlled by the control unit 7.

In operation, the stencil clamping part 27 clamps the leading end of the stencil sheet 18 transferred from the stencil making part 2. Then, while keeping on clamping the stencil sheet 18, the drum 26 is rotated to wrap the stencil sheet 18 on the outer circumferential surface of the drum 26. By pressing a printing paper 37 (printing medium), which is supplied from the paper feed part 4 in synchronous with the rotation of the drum 26, onto the stencil sheet 18 through the press roll 35, ink is transferred to the printing paper 37 through perforations in the stencil sheet 18, so that an image is printed on the paper 37.

The paper feed part 4 includes a paper feed table 38 on which printing papers 37 are stacked, primary paper feed rolls 39, 40 for transferring only one printing paper 37 at the highest position of the paper feed table 38, a pair of secondary paper feed rolls 41, 41 for introducing the above printing paper 37, which has been transferred from the paper feed table 38 by the primary paper feed rolls 39, 40, between the drum 26 and the press roll 35 in synchronous with the rotation of the drum 26, and a paper feed sensor 42 for detecting whether the printing paper 37 has been transported between the secondary paper feed rolls 41, 41 or not. The output of the paper feed sensor 42 is inputted to the control unit 7. In connection, the rotation of the main motor 25 is selectively transmitted to the primary paper feed rolls 39, 40 through a paper feed clutch 43. The operation of the paper feed clutch 43 is controlled by the control unit 7.

The paper discharging part 5 comprises a paper separation claw 44 for separating a printed paper 37 from the drum 26, a conveyer path 45 on which the printed paper 37 separated from the drum 26 is transported and a discharging table 46 on which the printed paper(s) 37 discharged from the path 45 is mounted.

The stencil disposal part 6 includes a stencil disposal unit 47 that introduces the leading end of a spent stencil sheet 18 unclamped from the outer circumferential surface of the drum 26 and transports the spent stencil sheet 18 while peeling it from the drum 26, a stencil disposal box 48 for accommodating the spent stencil sheet(s) 18 transported by the stencil disposal unit 47 and a stencil press member 49 for pushing the spent stencil sheet(s) 18 into an inmost part of the stencil disposal box 48.

The control unit 7 is formed by, for example, a microcomputer. The control unit 7 comprises a not-shown I/O (input and output) port through which signals are transmitted to and from the above-mentioned elements (e.g. the sensors 11, 12, 16, 28, the motors 15, 23, 25, etc.), a not-shown memory for storing information inputted through the sensors and programs for executing various operations of the stencil printing machine mentioned later and a not-shown central processing unit (CPU) for carrying out a variety of calculations based on the information inputted through the sensors. Additionally, the control unit 7 includes various driving circuits (not shown) for driving the above-mentioned elements, for example, the stepping motor 15, the thermal head 20, etc.

Next, respective structures of the drum 26, the stencil clamping part 27, the ink supply unit 54 and the ink recovery unit 73 will be described below.

As shown in FIGS. 2 to 4, the drum 26 includes a supporting shaft 50 fixed to an apparatus body H (see FIG. 1), a pair of side discs 52, 52 rotatably supported by the supporting shaft 50 through respective bearings 51, 51 and the outer circumferential wall 53 fixed to and between the discs 52, 52.

The outer circumferential wall 53 is rotated by the main motor 25 integrally with the side discs 52, 52. Additionally, the outer circumferential wall 53 is formed by an ink impermeable member having rigidity and allowing no passage of ink. Again, the outer circumferential wall 53 is coated with TEFLON (registered mark), providing a cylindrical surface having no irregularity.

The stencil clamping part 27 is provided with a clamping recess 53*a* extending along the axial direction of the supporting shaft 50 of the wall 53. The stencil clamping part 27 has its one side rotatably supported by the outer circumferential wall 53. Under an unclamping condition shown with a phantom line of FIG. 4, the stencil clamping part 27 is positioned so as to project from the outer circumferential wall 53. While, under a clamping condition shown with a solid line of FIG. 4, the stencil clamping part 27 is positioned so as not to project from the outer circumferential wall 53. Thus, the stencil clamping part 27 is constructed so as to clamp the stencil sheet 18 without projecting from the outer circumferential wall 53.

In operation, the outer circumferential wall 53 is rotated in a direction of arrow A of FIGS. 2 and 4. In connection, it is established that a position somewhat deviated from the stencil clamping part 27 in this rotating direction provides a "print starting point". Accordingly, the rotating direction A coincides with a printing direction M, while a printing area is defined by an area below the above print starting point. According to the first embodiment, the maximum printing area is established so as to be an area allowing a printing of printing papers of A3 size. In connection, the ink supply unit 54 is provided, at an upstream position of the maximum printing area of the outer circumferential wall 53 in the printing direction M, with an ink supply part 55.

As shown in FIGS. 2 to 5, the ink supply unit 54 comprises an ink container 57 for storing ink 56, an ink pump 58 for sucking the ink 56 in the ink container 57, a first pipe 59 connected to the ink pump 58 to supply the ink 56 sucked by the ink pump 58 into the drum 26, the above supporting shaft 50 connected to another end of the first pipe 59, a rotary joint 63 rotatably supported on the supporting shaft 50, a second pipe 64 having one end connected to the rotary joint 63 and the other end connected to the outer circumferential wall 53 of the drum 26 and the above ink supply part 55 where the other end of the second pipe 64 opens. In the supporting shaft 50, an ink passage 60 is formed to extend along the axial direction of the supporting shaft 50. Additionally, the supporting shaft 50 is provided, in opposite positions in the diametrical direction, with holes 61, 61 in communication with the ink passage 60. While, the rotary joint 63 has a communication hole 62 formed therein to communicate with the holes 61, 61. Note that the operation of the ink pump 58 is controlled by the control unit 7.

The ink supply part 55 is formed by an ink diffusion groove 65 (see FIG. 3) for diffusing the ink 56 (shown in FIG. 6) in a direction N perpendicular to the printing direction 65, which will be referred to as "cross-printing direction N" later, and an ink supply opening 55*a* having one end opened while leave a space against the ink diffusion groove 65 in the cross-printing direction N and the other end opened on the surface of the outer circumferential wall 53. More in detail, the ink diffusion groove 65 and the ink supply opening 55*a* are defined by disposing an ink distribution member 68 in the recess formed along a perpendicular direction (i.e. the cross-printing direction N) to the printing direction M of the outer circumferential wall 53. The ink supply opening 55*a* is formed to extend straightly along the cross-printing direction N, supplying the ink 56 in the cross-printing direction N of the outer circumferential wall 53 substantially uniformly.

As shown in FIGS. 2 to 5, the ink recovery unit 73 comprises an ink recovery opening 72 arranged on the downstream part of the maximum printing area S on the outer circumferential wall 53, a third pipe 74 having its one end opened to the ink recovery opening 72, the above rotary joint 63 connected to the other end of the third pipe 74 and also formed with a communication hole 75, the above supporting shaft 50 supporting the rotary joint 63 rotatably, a fourth pipe 77 having one end connected to the supporting shaft 50, an ink pump (e.g. trochoid pump) 78 interposed in the fourth pipe 77 to suck the ink 56 in the fourth pipe 77 and a recovery container 79 connected to the other end of the fourth pipe 77. In connection with the ink recovery unit 73, additionally, the supporting shaft 50 is formed with holes 76*a*, 76*a* which are communicable with the communication hole 75 and an inside ink passage 76*b* in communication with the holes 76*a*, 76*a*. Note that the operation of the ink pump 78 is also controlled by the control unit 7.

The ink supply opening 72 is defined by disposing a pipe fixing member 82 in a recess 81 on the outer circumferential wall 53 and formed continuously along the cross-printing direction N. Additionally, lateral ink recovery grooves 71, 71 and a top ink recovery groove 90 are defined so as to communicate with the ink recovery opening 72. The lateral ink recovery grooves 71, 71 are formed to continuously extend along right and left positions outside the maximum printing area S in the cross-printing direction N. While, the top ink recovery groove 90 is formed in a position on the "printing" upstream side of the ink supply opening 55*a* positioned on the "printing" upstream side of the maximum printing area S and formed so as to extend along the cross-printing direction N. That is, the ink recovery opening 72, the lateral ink recovery grooves 71, 71 and the top ink recovery groove 90 are arranged in a rectangular pattern so as to encircle the whole area of the maximum printing area S.

The rotary joint 63 is a constituent in common with the ink recovery unit 73 and the ink supply unit 54. The supporting shaft 50 is formed to have a double-pipe structure in view of providing an ink passage of the supply unit 54.

The operation of the so-constructed stencil printing machine will be described in brief.

When the printing mode is selected under condition that the imaginary-perforated stencil sheet is wrapped over the outer circumferential wall 53 of the drum 26, the driving of the ink supply unit 54 and the ink recovery unit 73 is started while rotating the outer circumferential wall 53 of the drum 26. Then, the ink 56 is supplied over the outer circumferential wall 53 through the ink supply opening 55*a* and retained between the outer circumferential wall 53 and the stencil sheet 18. Simultaneously, the press roll 35 is moved from the standby position to the press position.

In the paper feed part 4 in synchronous with the rotation of the drum 26, a printing paper 37 is supplied between the drum 26 and the press roll 35. Then, the so-supplied printing paper 37 is pressed on the outer circumferential wall 53 by the press roll 35 and also transported due to the rotation of the outer circumferential wall 53 of the drum 26. That is, the printing paper 37 is transported while adhering to the stencil sheet 18.

In conjunction with the transportation of the printing paper 37, as shown in FIG. 6, the ink 56 retained between the outer circumferential wall 53 of the drum 26 and the stencil sheet 18 is diffused toward the downstream side in the printing direction M while being urged by the press roll 35. Simultaneously, the so-diffused ink 56 exudes through the perforations in the stencil sheet 18 and is transferred onto the printing paper 37. In this way, an ink image is printed on the printing paper 37 in the course of its passing through a gap between the outer circumferential wall 53 of the drum 26 and the press roll 35. The printing paper 37 passing through the gap between the outer circumferential wall 53 and the press roll 35, especially, the leading end of the paper 37 is ripped from the drum 26 by the paper separation claw 44. Subsequently, the printing paper 37 separated from the drum 26 is discharged onto the paper discharging table 46 through the conveyer path 45 and stacked in the table 46.

During the printing operation, the extra ink flowing out toward the downstream side of the maximum printing area S on the outer circumferential wall 53 flows into the ink recovery opening 72. The ink flowing into the ink recovery opening 72 is collected into the recovery container 79 due to suction force of the recovery pump 78 of the ink recovery unit 73. Additionally, the extra ink flowing into the ink recovery grooves 71, 90 is also collected into the recovery container 79 through the ink recovery opening 72 due to the suction force of the recovery pump 78.

When completing the printing operation of a predetermined number of papers, the rotation of the outer circumferential wall 53 of the drum 26 is stopped, while the drive of the ink supply unit 54 is also stopped. The driving of the ink recovery unit 73 is stopped in little arrear of the operational stop of the ink supply unit 54 and the extra ink remaining on the outer circumferential wall 53 is collected through the ink recovery opening 72. Correspondingly, the press roll 35 is returned from the press position to the standby position, so that the apparatus is brought into the standby mode.

When a new stencil making mode is selected, a stencil disposal operation and a stencil-making/stencil-fitting mode are carried out in parallel. We now describe the stencil disposal operation. First of all, the stencil clamping part 27 of the drum 26 is moved to the unclamping position. As a result, the restriction against the leading end of the stencil sheet 18 is released. Next, the outer circumferential wall 53 of the drum 26 is rotated, so that the unclamped leading end of the stencil sheet 18 is introduced by the stencil disposal unit 47 with the rotation of the outer circumferential wall 53 of the drum 26. When the whole stencil sheet 18 is accommodated in the disposal box 48, the rotation of the outer circumferential wall 53 of the drum 26 is stopped at a designated stencil-fitting position, completing the stencil disposal operation.

In the stencil making/fitting operation, a stencil making operation (part) will be described below. First of all, with the rotations of the platen roll 21 and the stencil feed rolls 22, 22, a stencil sheet 18 is transferred. While, based on the image data scanned by the original scanning part 1, a number of heater elements in the thermal head 20 are selectively heated, so that the stencil sheet 18 is perforated in heat to make a stencil. Thereafter, a designated part of the so-perforated stencil sheet 18 will be cut by the stencil cutter 24, producing a stencil sheet 18 having predetermined dimensions.

In the stencil making/fitting operation, a stencil fitting operation (part) will be described with reference to FIGS. 7 to 11. Note that this stencil fitting operation constitutes one of features of the present invention and is started in the course of making the above stencil sheet 18.

Figure 7:
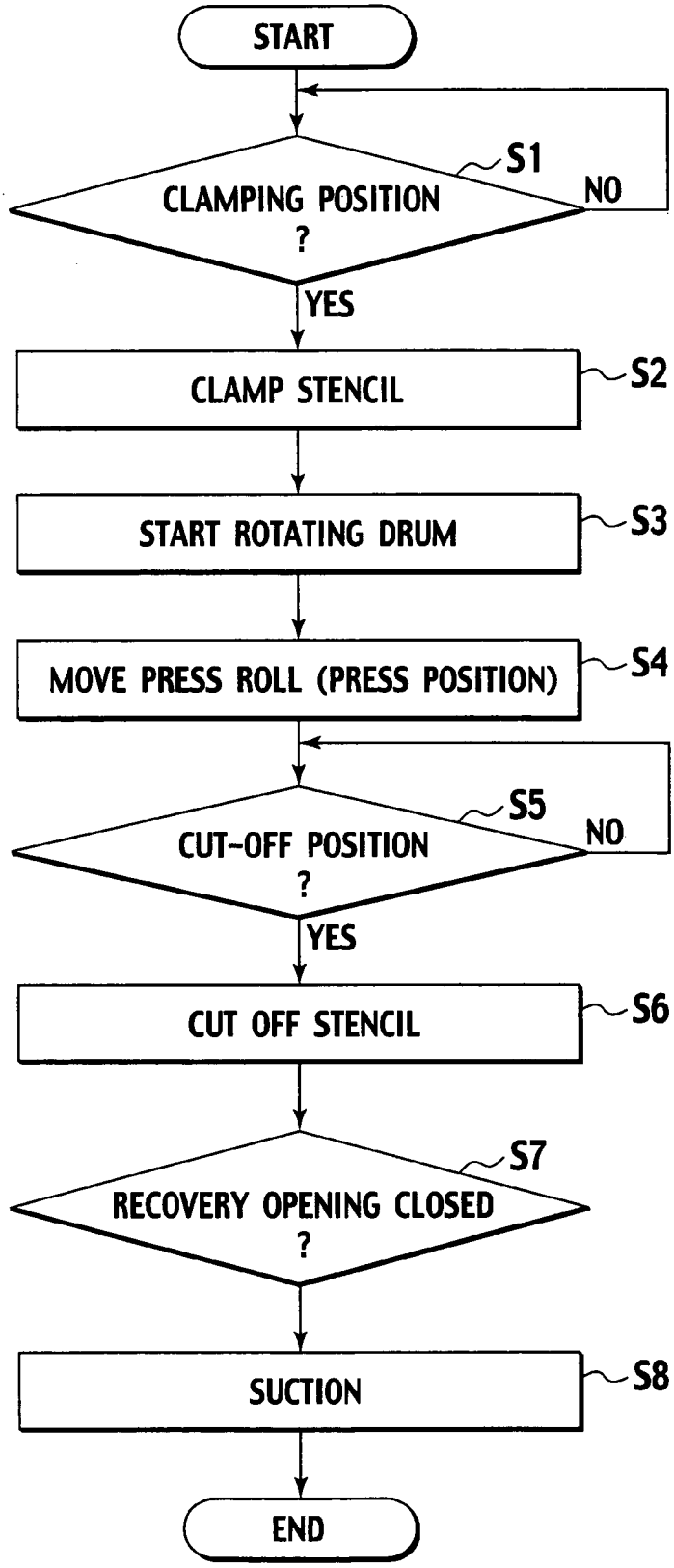
FIG. 7 is a flow chart explaining a stencil fitting operation of the stencil printing machine in accordance with the embodiment of the present invention.

FIG. 7 is a flow chart of the stencil fitting operation. A program for executing the stencil fitting operation in accordance with the flow chart of FIG. 7 is previously stored in a designated area in the memory of the control unit 7.

In process of the stencil making operation, the leading end of the perforated stencil sheet 18 approaches the stencil clamping part 27 of the drum 26. Then, the rotation of the drum 26 is suspended in a position shown in FIG. 1.

At step S1, it is judged whether or not the leading end of the stencil sheet 18 reaches the stencil clamping part 27 of the drum 26. This judgment may be performed by an operator's visual observation. Alternatively, the judgment may be automatically accomplished by e.g. an optical sensor (not shown) arranged in the vicinity of the stencil clamping part 27 of the drum 26.

If the judgment at step S1 is Yes, that is, when the leading end of the stencil sheet 18 reaches a wall's position where the stencil clamping part 27 exists, then the routine goes to step S2. At step S2, it is performed that the stencil clamping part 27 clamps the leading end of the stencil sheet 18. In connection, this clamping operation is carried out automatically or manually. In case of automatic clamping, the stencil clamping part 27 would be constructed so as to be operated by an actuator (not shown) controlled by the control unit 7.

At next step S3, it is executed to start a rotation of the drum 26 in the direction of arrow A. As a result of rotating the drum 26, the stencil sheet 18 is gradually wound around the outer circumferential wall 53.

Figure 8:
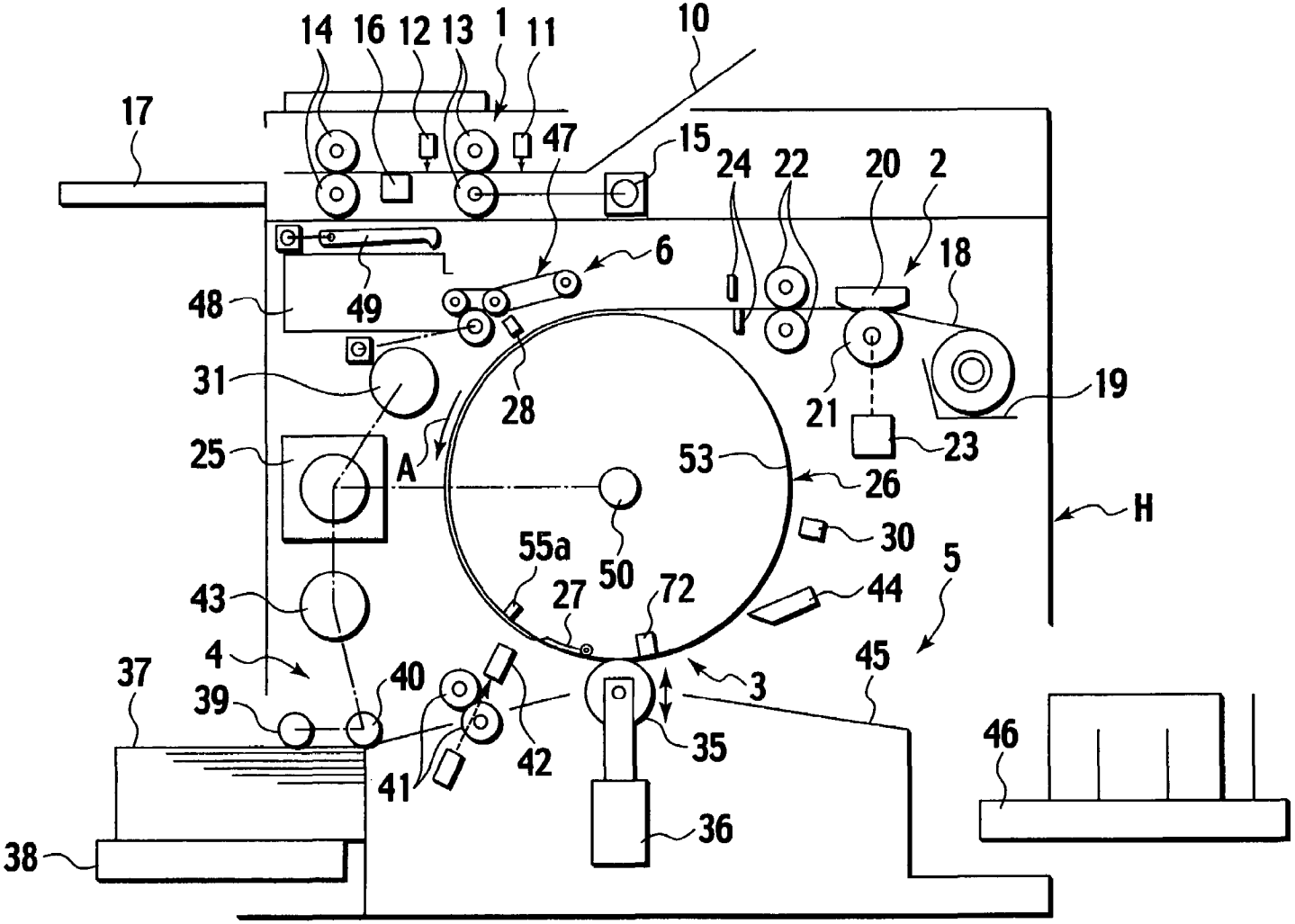
FIG. 8 is a schematic structural view showing a stencil fitting process of the stencil printing machine, also showing the embodiment of the present invention.
Figure 9:
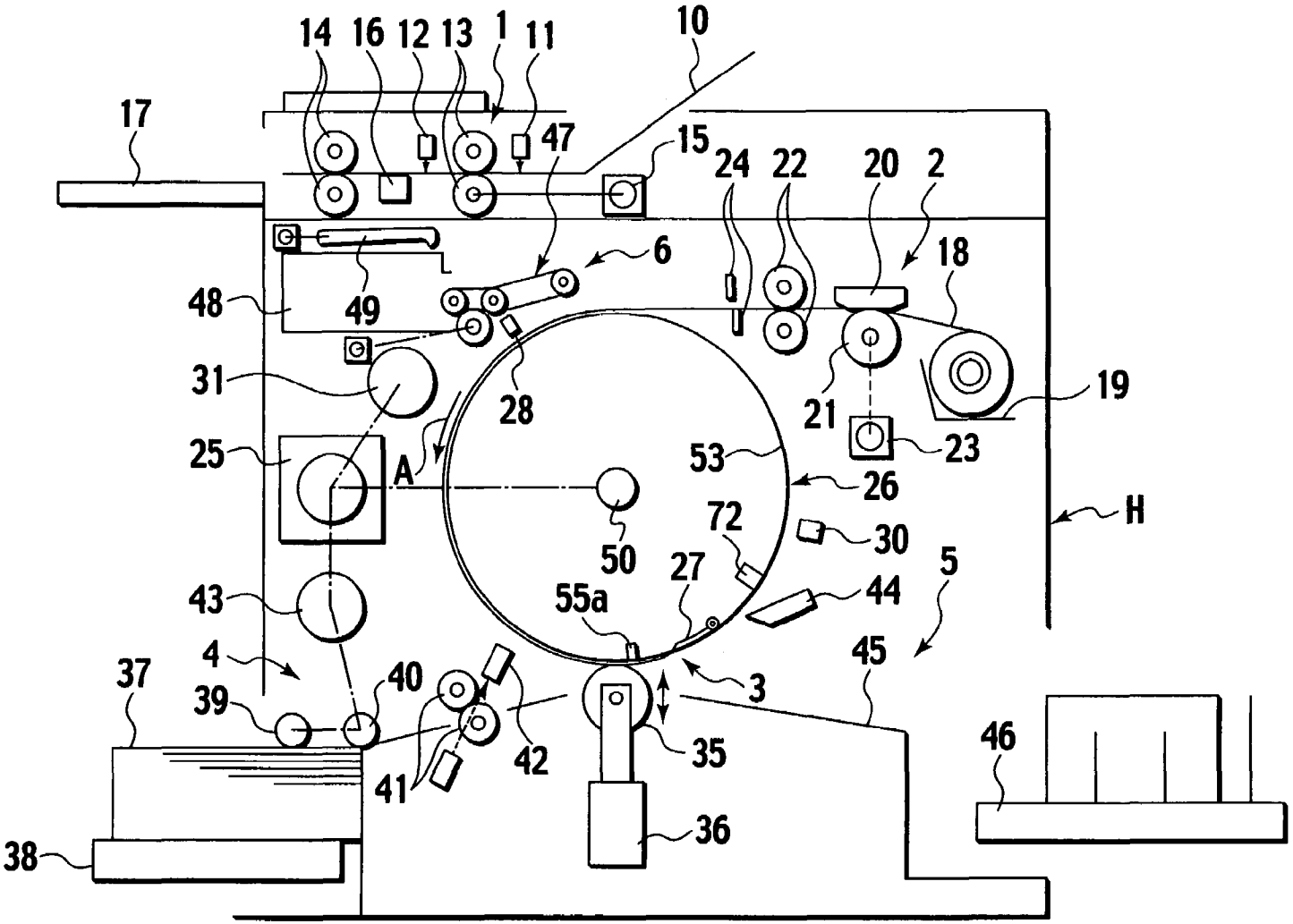
FIG. 9 is a schematic structural view showing the stencil fitting process of the stencil printing machine, also showing the embodiment of the present invention.

At next step S4, it is executed to activate the solenoid unit 36 in order to displace the press roll 35 from the standby position to the press position. FIG. 8 shows such a condition where the stencil sheet 18 is wrapped over a generally half around of the outer circumferential wall 53, while the press roll 35 is shifted to the press position.

Here, it should be noted that before cutting the perforated stencil sheet 18 by predetermined dimensions (see FIGS. 8 and 9), it is subjected to a tension (tensile stress) originating in the stencil making part 2. Therefore, under a condition of FIG. 9 where the stencil clamping part 27 has passed through the press roll 35, it is obvious that the stencil sheet 18 is certainly wrapped over the outer circumferential wall 53 without producing any wrinkle, owing to the tension and the pressure by the press roll 35.

We return to the flow chart of FIG. 7 again.

At step S5, by detecting the outputs of the reference position sensor 30 and the rotary encoder 31, it is executed to calculate the present rotating position of the drum 26. Based on the calculation result, at the same step, it is further executed to judge whether the position of the stencil clamping part 27 reaches a designated rotating position of the drum 26 where a continuous stencil sheet is to be cut off into the designated stencil sheet 18. Note, the above rotating position of the drum 26 will be referred to as "stencil-cutting position" after. Of course, the stencil-cutting position changes dependently on specification (dimensions) of the stencil sheet 18 to be produced.

Figure 10:
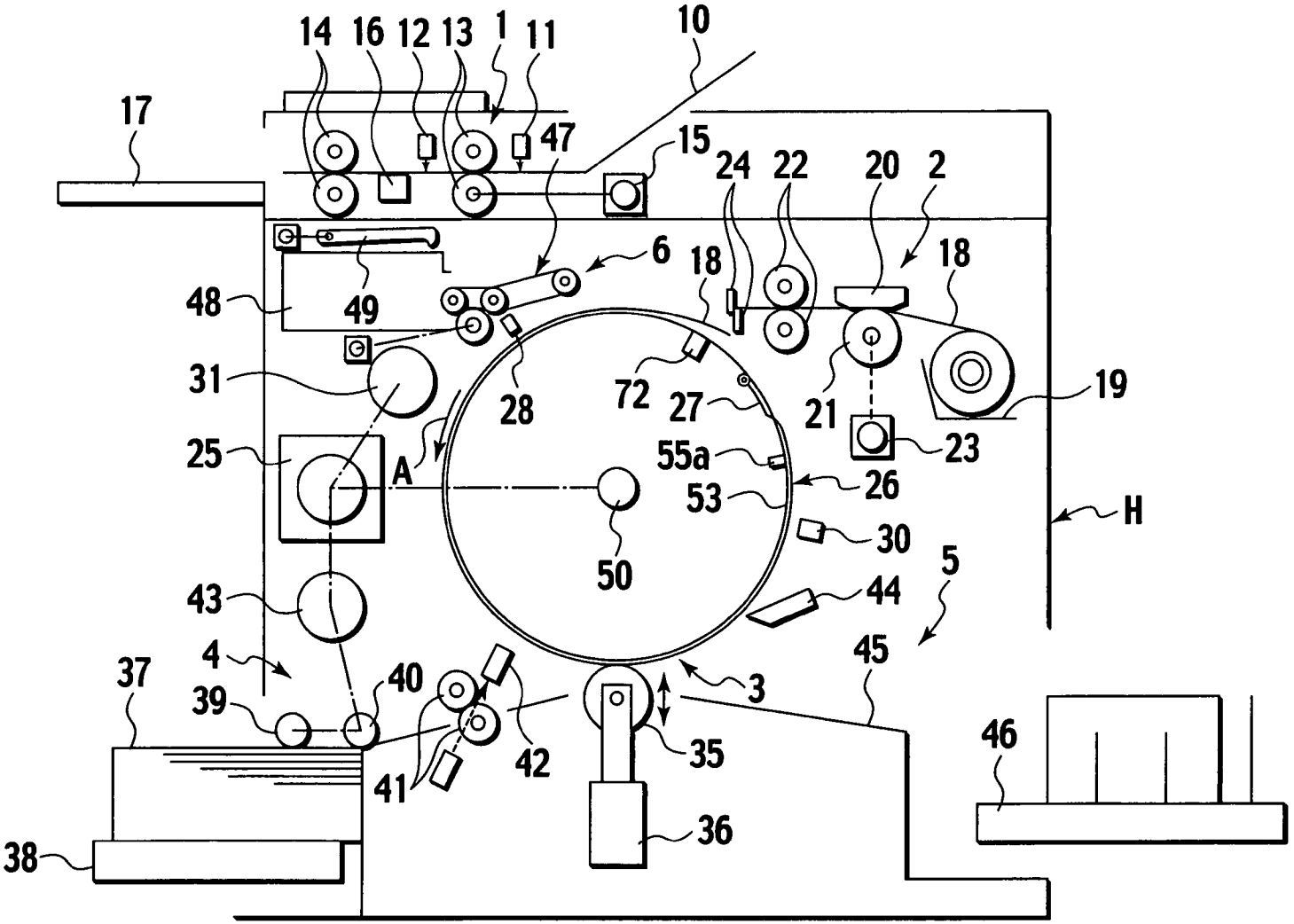
FIG. 10 is a schematic structural view showing the stencil fitting process of the stencil printing machine, also showing the embodiment of the present invention.
Figure 11:
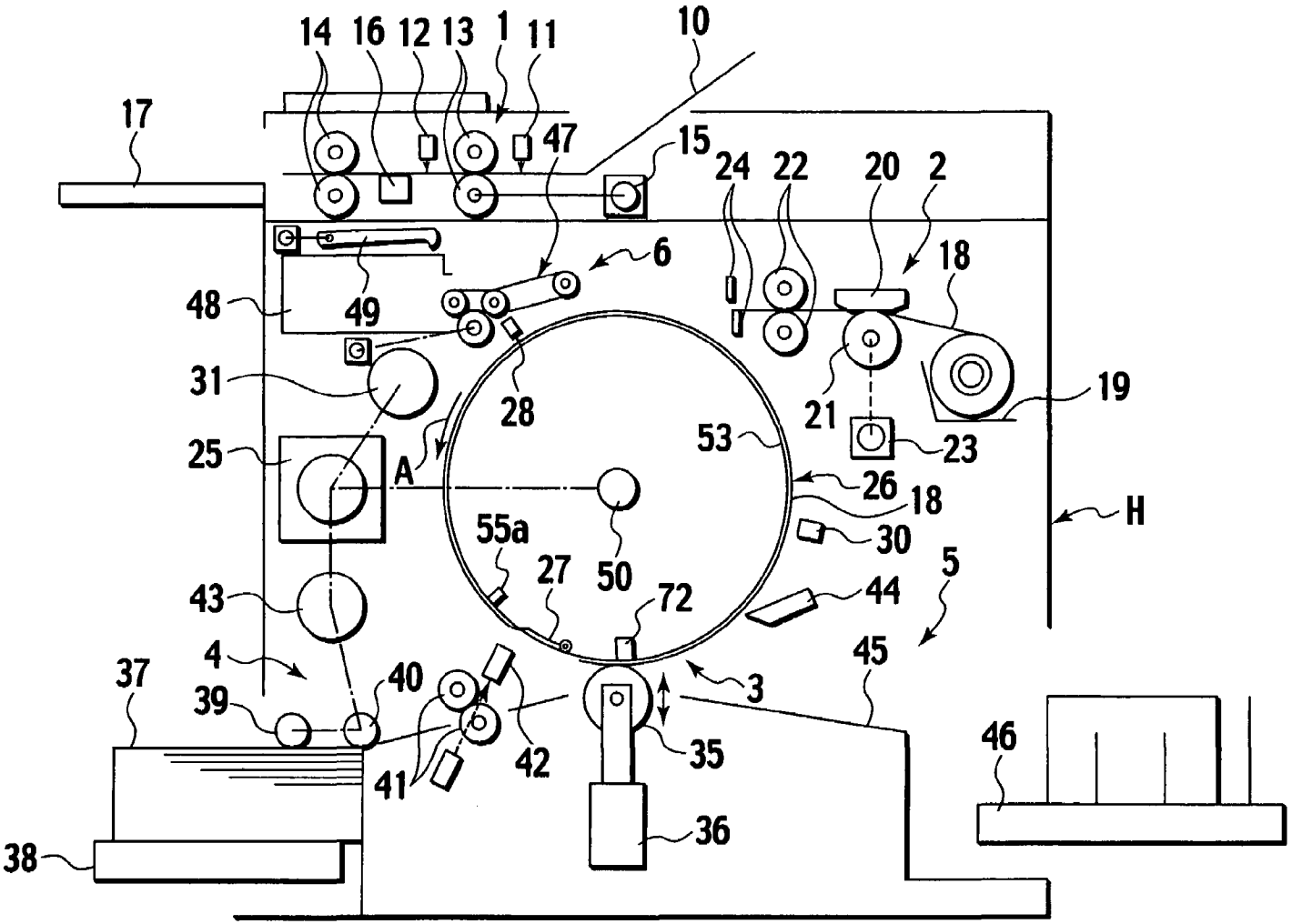
FIG. 11 is a schematic structural view showing the stencil fitting process of the stencil printing machine, also showing the embodiment of the present invention.

If the judgment at step S5 is Yes, in other words, when the stencil clamping part 27 reaches the stencil-cutting position, then the routine goes to step S6 where the stencil cutter 24 is operated to cut off the continuous stencil sheet into the stencil sheet (piece) 18. FIG. 10 illustrates a condition that the stencil cutter 24 has just cut off the continuous stencil sheet into the stencil sheet (piece) 18. Then, once the continuous stencil sheet is cut off by the stencil cutter 24, the tension originating in the stencil making part 2 is not applied on the finished stencil sheet 18 any longer. However, according to the embodiment, the wrapping operation of the finished stencil sheet 18 can be maintained without producing any wrinkle owing to the pressing operation of the press roll 35 as one follower.

Even after cutting off the stencil sheet, the drum 26 is maintained to rotate in order to wind the finished stencil sheet 18 around the outer circumferential wall 53. At step S7, as similar to step S6, it is executed to calculate the present rotating position of the drum 26. Further, based on the calculated rotating position of the drum 26, it is executed at step S7 to judge whether the ink recovery opening 72 is being closed up by a sheet's end portion (near the trailing end of the sheet 18) due to the pressing operation of the press roll 35 with progress of the rotation of the outer circumferential wall 53. FIG. 10 illustrates such a condition that the sheet's end portion has just closed up the ink recovery opening 72 formed on the outer circumferential wall 53. If the judgment at step S7 is Yes, that is, when the ink recovery opening 72 is closed up by the sheet's end portion close to the trailing end of the stencil sheet 18, then the routine goes to step S8 where the sucking operation is started by the ink recovery unit 73. In detail, the ink pump 78 interposed in the fourth pipe 77 is driven by an output signal from the control unit 7. In connection, the starting point of the sucking operation by the ink recovery unit 73 is established between a point of time when a drum's part corresponding to the position of the ink recovery opening 72 passes through the press roll 35 completely and another point of time when the press roll 35 presses the trailing end of the stencil sheet 18. Since the end portion of the stencil sheet 18 is sucked and absorbed onto the outer circumferential wall 53, the wrapping condition of the stencil sheet 18 without producing any wrinkle is maintained even after the trailing end of the sheet 18 has passed through the press roll 35. In this way, the stencil fitting operation is completed (i.e. an end of the routine). Note that this sucking operation is maintained even in the printing mode. From above, in spite of the drum 26 having the outer circumferential wall 53 formed by the ink impermeable member, it is possible to fit the stencil sheet 18 onto the drum 26 without producing any wrinkle.

In conclusion, according to the above-mentioned embodiment of the invention, the beginning of the sucking operation of the ink recovery unit 73 is preset between the point of time when the ink recovery opening 72 passes through the press roll 35 completely and the point of time when the press roll 35 presses the trailing end of the stencil sheet 18. Accordingly, even if the cutting operation for the stencil sheet 18 has been carried out before the stencil sheet's part in the vicinity of the trailing end closes up the ink recovery opening 72, it is possible to fit the stencil sheet 18 onto the outer circumferential wall 53 of the drum 26 without producing any wrinkle.

Regarding the conventional apparatus, it should be again noted that if cutting operation for the stencil sheet 18 is carried out before the stencil sheet's part in the vicinity of the trailing end closes up the ink recovery opening 72, there arises a possibility that wrinkles are produced about the trailing end of the stencil sheet 18 and its neighborhood, which are free from the pressure of the press roll 35, due to reaction force of the stencil sheet 18 at cutting. Additionally, if the trailing end of the stencil sheet 18 and its neighborhood close up the ink recovery opening 72 while leaving wrinkles, then the trailing end of the stencil sheet 18 is absorbed onto the outer circumferential wall 53 while remaining the wrinkles in the vicinity of the trailing end. In such a case, even if the press roll 35 presses the trailing end of the stencil sheet 18 and its neighborhood, there is no possibility that the wrinkles are removed away from the sheet 18, causing a situation where the stencil sheet 18 is fitted onto the drum 26 while remaining the wrinkles.

On the contrary, according to the embodiment of the invention, the trailing end (and its neighborhood) of the stencil sheet 18 is sucked onto the outer circumferential wall 53 of the drum 26 at the first time when the trailing end portion of the stencil sheet 18 closes up the ink recovery opening 72 while being wound around the drum 26 without producing wrinkle due to the pressing of the press roll 35. Therefore, even if the cutting operation of the stencil sheet 18 has been carried out before the stencil sheet 18 and its neighborhood close up the ink recovery opening 72, it is possible to fit the stencil sheet 18 to the drum 26 without producing any wrinkle certainly.

As a reference, when the cutting operation of the stencil sheet 18 is carried out after the stencil sheet 18 and its neighborhood has closed up the ink recovery opening 72, the stencil sheet 18 could be certainly fitted to the drum 26 without producing any wrinkle even if the sucking operation of the ink recovery unit 73 is started from the beginning of the stencil-fitting operation.

In the shown embodiment, the press roll 35 constitutes the press unit of the invention. Therefore, there is no need to add any component to the apparatus in order to wind the stencil sheet 18 without producing any wrinkle. In the modification, of course, the stencil printing machine may be equipped with any pressing unit (mechanism) in place of the press roll 35.

Additionally, according to the embodiment, since the outer circumferential wall 53 is provided with the ink recovery grooves 71, 90 in addition to the ink recovery opening 72, it is possible to collect ink leaking out of the maximum printing area S effectively. Of course, the outer circumferential wall 53 is formed with the ink recovery opening 72 only.

Finally, it will be understood by those skilled in the art that the foregoing descriptions are nothing but one embodiment of the disclosed stencil printing machine and its control method and therefore, various changes and modifications may be made within the scope of claims.

What is claimed is:

1. A stencil printing machine comprising:

a drum rotated by a main motor, the drum having an outer circumferential wall formed by an ink impermeable member;

a stencil clamping part provided on the outer circumferential wall to clamp a leading end of a stencil sheet;

an ink supply unit having an ink supply opening positioned in the outer circumferential wall to supply a surface thereof with ink;

a press roll arranged close to the drum to press a printing medium on supply against the outer circumferential wall of the drum;

an ink recovery unit having an ink recovery opening formed on a downstream side of a maximum printing area in a rotating direction of the drum to collect ink flowing into the ink recovery opening by suction, the maximum printing area being defined on the outer circumferential wall;

a press unit for pressing the stencil sheet onto the outer circumferential wall of the drum; and a control unit for controlling respective operations of the main motor, the ink recovery unit and the press unit, wherein, in process of fitting the stencil sheet on the drum while clamping the leading end of the stencil sheet by the stencil clamping part, the control unit allows the press unit to press the stencil sheet onto the outer circumferential wall of the drum and further allows the ink recovery unit to start a suction operation through the ink recovery opening.

2. The stencil printing machine of claim 1, wherein a starting point of the sucking operation by the ink recovery unit in the process of fitting the stencil sheet on the drum is established between a point of time when the ink recovery opening of the ink recovery unit passes through the press unit completely and another point of time when the press unit presses a trailing end of the stencil sheet.

3. The stencil printing machine of claim 1, further comprising a position detecting device for detecting a rotational position of the drum in rotation, wherein the control unit controls the operation of the ink recovery unit and the operation of the press unit on a basis of the rotational position of the drum detected by the position detecting device.

4. The stencil printing machine of claim 3, wherein the position detecting device comprises:

a reference-position detecting sensor arranged in the stencil printing machine and connected to the control unit, for detecting a reference position defined in the drum; and a rotary encoder arranged in the stencil printing machine and connected to the control unit, for outputting pulse signals with a rotation of the main motor.

5. The stencil printing machine of claim 1, wherein the press unit comprises the press roll.

6. The stencil printing machine of claim 1, wherein the ink recovery unit further includes one ink recovery groove on the upstream side of the maximum printing area and a pair of ink recovery grooves on both sides of the maximum printing area, the ink recovery grooves are communicated with each other, and the ink recovery grooves are communicated with the ink recovery opening.

* * * * *